US007874150B2

(12) United States Patent
Stadler et al.

(10) Patent No.: US 7,874,150 B2
(45) Date of Patent: Jan. 25, 2011

(54) EXHAUST SYSTEM

(75) Inventors: Bernd Stadler, Eberdingen (DE); Volker Hoffmann, Hemmingen (DE); Eberhard Storz, Kirchheim (DE)

(73) Assignee: Dr. Ing. h.c.F. Porsche AG, Stuttgart (DE)

( * ) Notice: Subject to any disclaimer, the term of this patent is extended or adjusted under 35 U.S.C. 154(b) by 915 days.

(21) Appl. No.: 11/805,876

(22) Filed: May 24, 2007

(65) Prior Publication Data

US 2007/0271911 A1 Nov. 29, 2007

(30) Foreign Application Priority Data

May 24, 2006 (DE) ..... 10 2006 024 269

(51) Int. Cl.
*F01N 1/00* (2006.01)

(52) U.S. Cl. ..... 60/322; 180/309

(58) Field of Classification Search ..... 60/322; 180/309

See application file for complete search history.

(56) References Cited

U.S. PATENT DOCUMENTS

| | | | | |
|---|---|---|---|---|
| 4,623,279 | A * | 11/1986 | Smith | 404/93 |
| 5,466,900 | A * | 11/1995 | Knapp | 181/227 |
| 6,220,387 | B1 * | 4/2001 | Hoppes et al. | 181/259 |
| 6,491,418 | B1 * | 12/2002 | Chen | 362/487 |
| 6,595,318 | B2 | 7/2003 | Ebinger et al. | |
| 7,032,702 | B2 | 4/2006 | Rinklin | |
| 2002/0053483 | A1 | 5/2002 | Ebinger et al. | |
| 2004/0163874 | A1 | 8/2004 | Rinklin | |
| 2005/0199381 | A1 * | 9/2005 | Mercz et al. | 165/172 |

FOREIGN PATENT DOCUMENTS

| | | | |
|---|---|---|---|
| DE | 199 14 426 | C2 | 10/2000 |
| DE | 10025121 | A1 | 12/2001 |
| DE | 103 55 472 | A1 | 7/2005 |
| EP | 1428743 | A2 | 6/2004 |
| JP | 2005299411 | A | 10/2005 |

OTHER PUBLICATIONS

European Search Report dated Apr. 21, 2008.

* cited by examiner

*Primary Examiner*—Hoang M Nguyen

(57) ABSTRACT

An exhaust system has an exhaust tailpipe cover provided in an outlet region and, on the inside, contains inner exhaust pipes which are disposed spaced apart from the exhaust tailpipe cover by a passage. The passage in the exhaust tailpipe cover results in the exhaust tailpipe cover being exposed to as little thermal loading as possible and avoids transmitting heat to a surrounding vehicle rear part, in particular made of plastic.

8 Claims, 5 Drawing Sheets

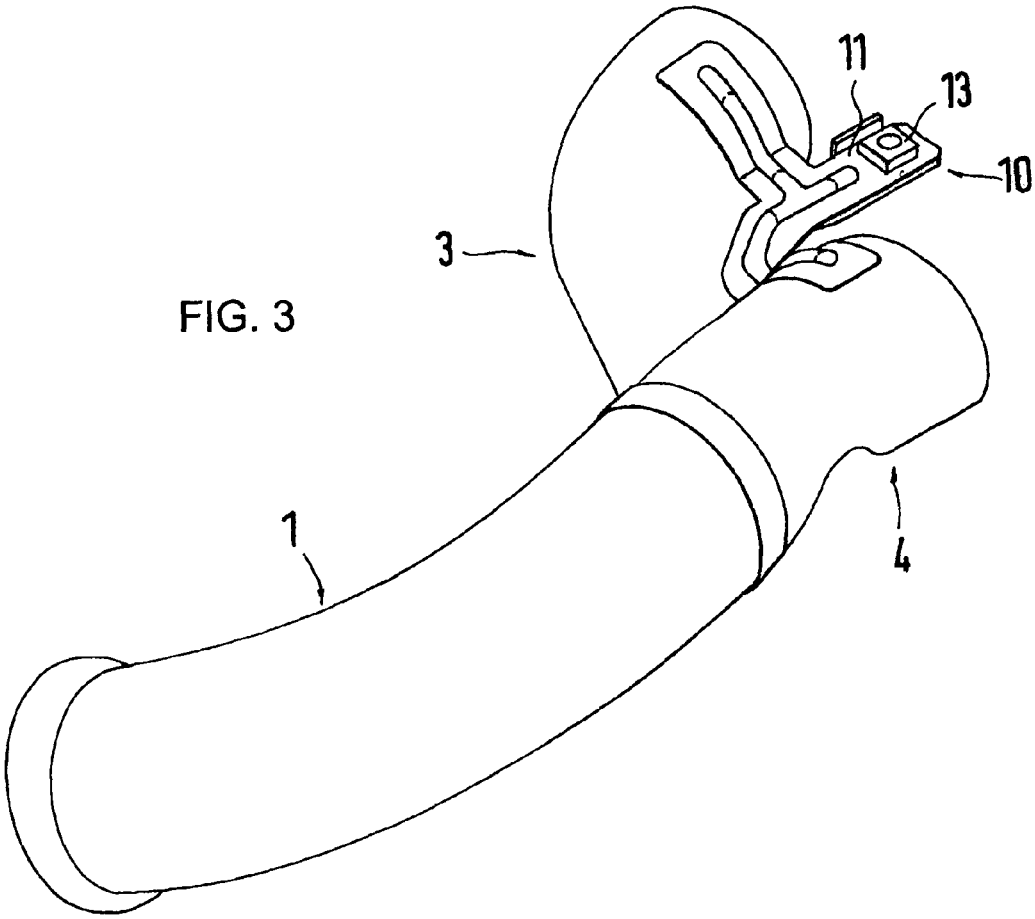
FIG. 3
FIG. 4
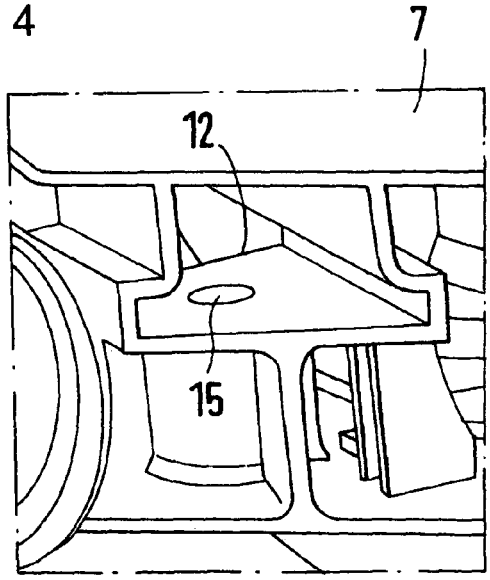

EXHAUST SYSTEM

CROSS-REFERENCE TO RELATED APPLICATION

This application claims the priority, under 35 U.S.C. §119, of German application DE 10 2006 024 269.6-13, filed May 24, 2006; the prior application is herewith incorporated by reference in its entirety.

BACKGROUND OF THE INVENTION

Field of the Invention

The invention relates to an exhaust system for a motor vehicle, with an exhaust tailpipe cover which can be placed onto exhaust pipes and disposed in a cutout of a vehicle rear part.

Published, non-prosecuted German patent application DE 10 355 472 A1 discloses an exhaust tailpipe cover for an exhaust system of a motor vehicle, which exhaust tailpipe cover has an exhaust pipe with an inner pipe which is pushed onto it and deflects the exhaust gas flow downward toward the carriageway surface. The inner pipe is surrounded by a cover pipe.

SUMMARY OF THE INVENTION

It is accordingly an object of the invention to provide an exhaust system which overcomes the above-mentioned disadvantages of the prior art devices of this general type, which has an exhaust tailpipe cover which is exposed to as little thermal loading as possible and avoids transmitting heat to a surrounding vehicle rear part, in particular made of plastic.

With the foregoing and other objects in view there is provided, in accordance with the invention, an exhaust system for a motor vehicle. The exhaust system contains two exhaust pipes, a holding device, and an exhaust tailpipe cover supported by the exhaust pipes and disposed in a cutout of a vehicle rear part. The exhaust tailpipe cover is connected to at least one of the exhaust pipes via the holding device. Two individual inner exhaust pipes are disposed in each case between the exhaust tailpipe cover and the exhaust pipes and plugged onto the two exhaust pipes. The individual inner exhaust pipes are connected fixedly to the exhaust tailpipe cover and together create a continuous passage formed all a way around between the two individual inner exhaust pipes and the exhaust tailpipe cover accommodating them.

The advantages primarily achieved by the invention relate in that, by providing an air gap insulation between the inner exhaust pipes directly guiding the exhaust gas and an exhaust tailpipe cover, a direct transmission of heat to the exhaust tailpipe cover is avoided and therefore also the vehicle rear part made of plastic is not exposed to excessive thermal loading. This takes place by the exhaust tailpipe cover being connected to one or two exhaust pipes of the exhaust system via a holding device, and individual inner exhaust pipes being disposed in each case between the exhaust tailpipe cover and the exhaust pipes and being held such that they are plugged onto the two exhaust pipes and being connected fixedly to the exhaust tailpipe cover, with a continuous passage being formed all the way around between the two inner exhaust pipes and the exhaust tailpipe cover accommodating them. In the driving state, the passage can therefore act in a heat-regulating manner on account of air flowing through it.

So that a stable connection is provided between the exhaust pipes and the exhaust tailpipe cover, it is furthermore provided according to the invention that the holding device is fastened between the two exhaust pipes or else to only one exhaust pipe and a protruding holding tongue of the holding device is disposed in a vertical center plane of the two exhaust pipes, which holding tongue can be pushed into a groove-type receptacle, for example a T-groove-type receptacle, of the exhaust tailpipe cover and is held via a fastener. A threaded nut is fastened on the protruding holding tongue, and a threaded screw can be guided in a bore of the exhaust tailpipe cover to the threaded nut on the holding tongue and can be connected to the threaded nut. The threaded screw is fitted from the lower side of the exhaust system and also a laterally secure support is ensured via the interlocking holding of the holding tongue in the dovetailed receptacle, which is required in particular during vibrations on the exhaust system.

The inner exhaust pipes, which are disposed between the exhaust pipes and the exhaust tailpipe cover and which conduct exhaust gas directly, virtually form an extension of the exhaust pipes. The two inner exhaust pipes have a plurality of outwardly prestressed, resilient clamping elements on their outer circumferential surfaces, which clamping elements, when inserted in the exhaust tailpipe cover, are supported in a manner held by the inner wall and bring about a fixed connection to the exhaust tailpipe cover via screwing measures.

According to the invention, in order to fasten the two inner exhaust pipes in the exhaust tailpipe cover, mutually facing, protruding supporting limbs are fastened to the outer circumferential surface of the two inner exhaust pipes and, when introduced into the exhaust tailpipe cover, are supported, for example, on stops disposed adjacent to the groove-type receptacle and are secured via the screwing measures. The effect thereby advantageously achieved, according to the invention is that the inner exhaust pipes are connected fixedly to the exhaust tailpipe cover, and therefore no contact with the inner wall of the exhaust tailpipe cover can occur, even due to vibrations which occur.

Furthermore, the two inner exhaust pipes together with the two exhaust pipes can be plugged on directly by a widened pipe portion, and those free ends of the two inner exhaust pipes which face away from the widened pipe portion have, all the way around, an air gap with respect to the inner circumferential surface of the exhaust tailpipe cover at the discharge region of the exhaust gases. Removal of the exhaust gases of the internal combustion engine is therefore possible by the exhaust pipes via the inner pipes without the latter coming into contact with the exhaust tailpipe cover.

The inner exhaust pipes are each configured in the discharge region such that they widen in a trumpet-shaped manner, and an air gap is formed between the mouth regions of the exhaust tailpipe and the mouth regions of the inner exhaust pipes, with the inner exhaust pipes each being disposed continuously in the exhaust tailpipe cover at a distance from the inner wall, and the passage being produced. The passage between the inner exhaust pipes and the exhaust tailpipe cover can give rise, in the driving mode, to an air throughflow and, resulting therefrom, to heat being conducted away from the inner exhaust pipes which are heated by exhaust gases. In particular, if the exhaust tailpipe cover is painted, it is not damaged by thermal loading.

Other features which are considered as characteristic for the invention are set forth in the appended claims.

Although the invention is illustrated and described herein as embodied in an exhaust system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is a diagrammatic, perspective view of a holding device on the exhaust pipes in the form of a protruding holding tongue with a threaded nut;

FIG. 4 is a diagrammatic, enlarged perspective view of a dovetailed receptacle in the exhaust tailpipe cover for receiving the holding device shown in FIG. 3;

DESCRIPTION OF THE PREFERRED EMBODIMENTS

Figure 1:
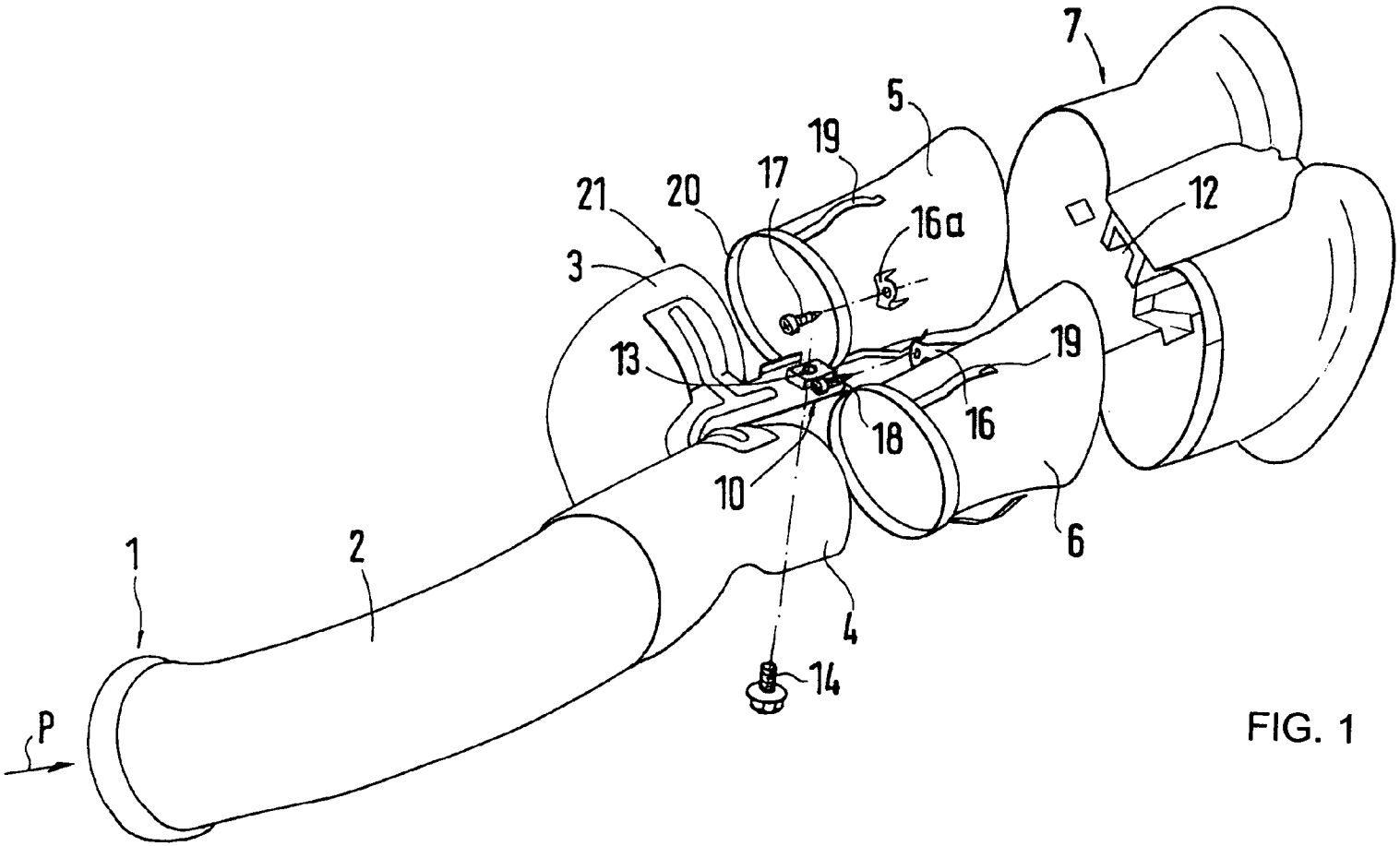
FIG. 1 is a diagrammatic, exploded perspective view of an end region of an exhaust system with exhaust pipes, inner exhaust pipes and an exhaust tailpipe cover, according to the invention.
Figure 2:
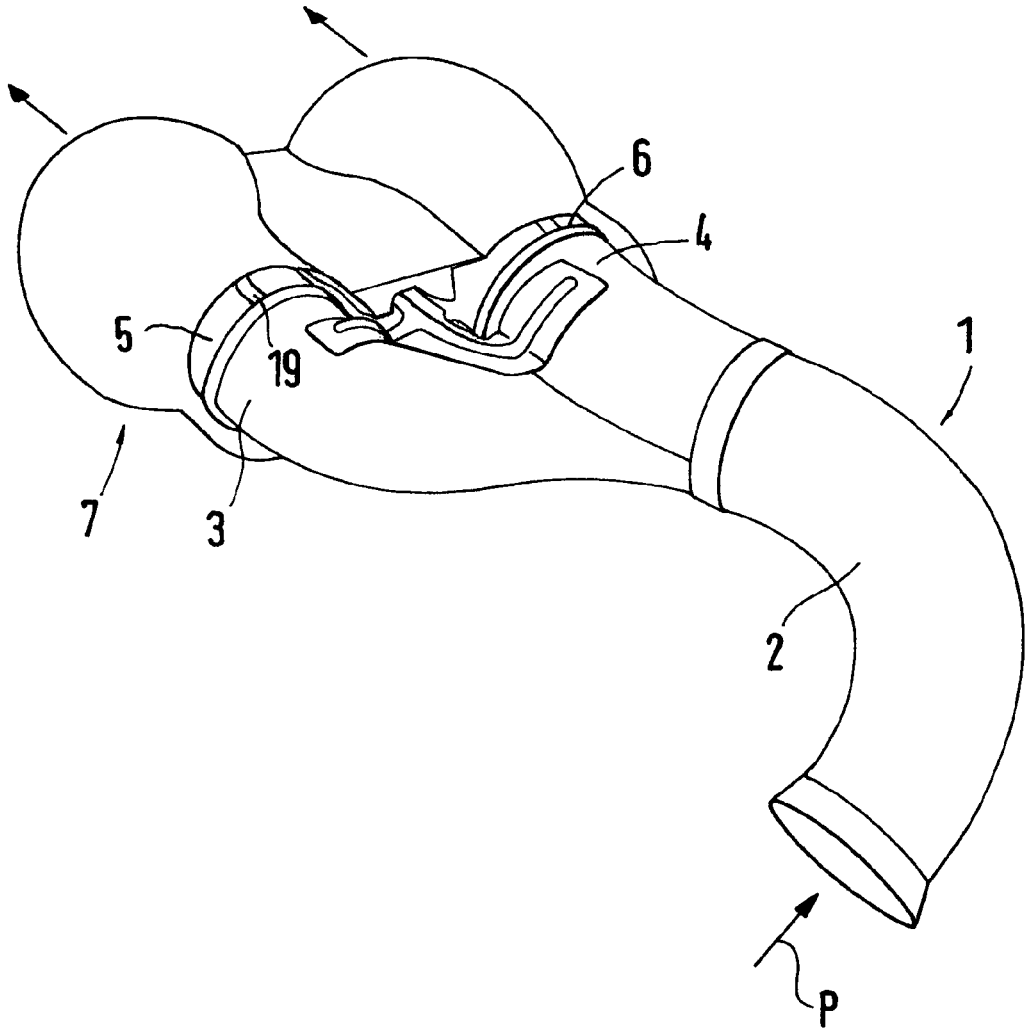
FIG. 2 is a diagrammatic, perspective view of the end region of the exhaust system assembled together with the exhaust tailpipe cover.
Figure 7:
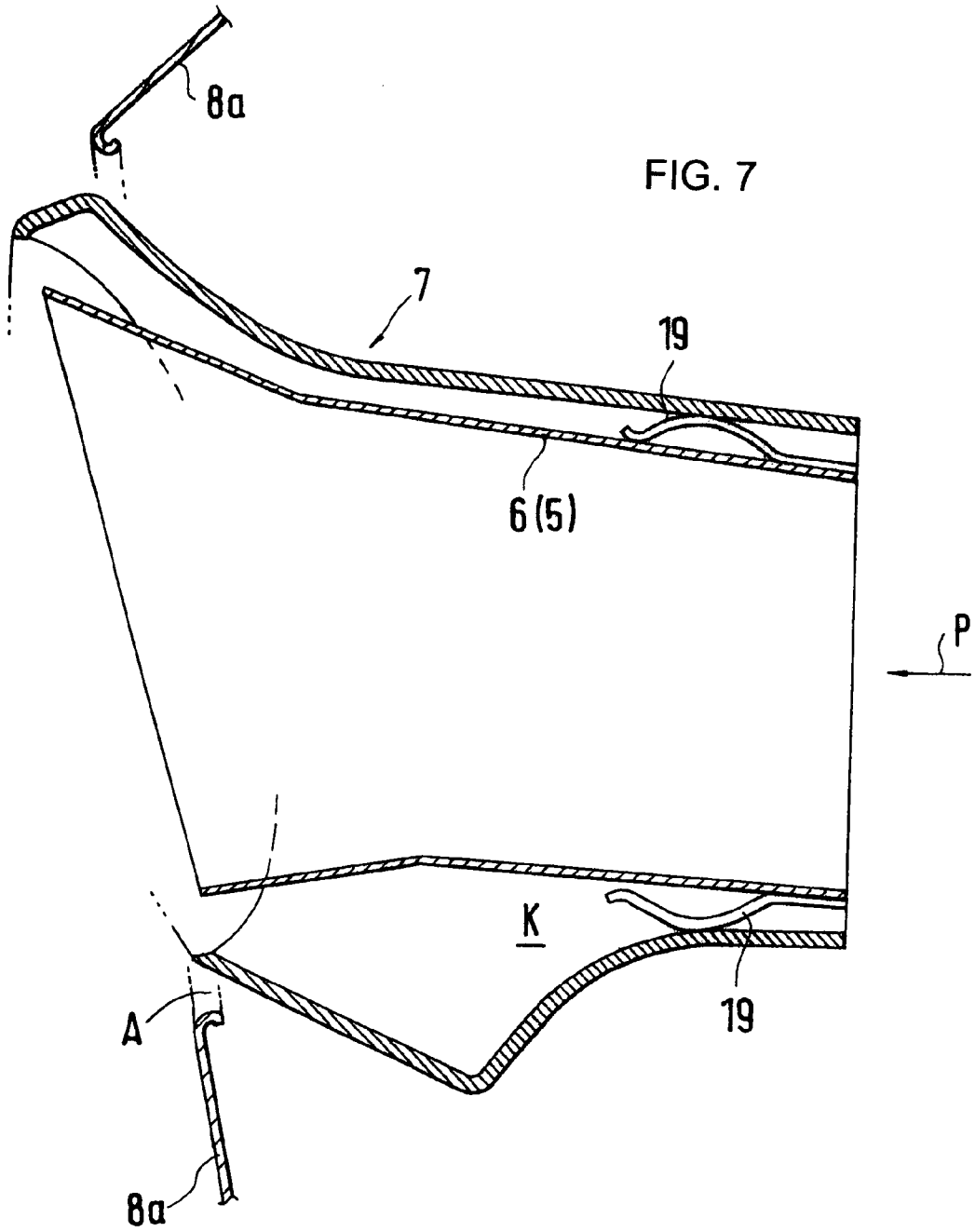
FIG. 7 is a diagrammatic, section view through the exhaust tailpipe cover with the inserted inner exhaust pipe and illustrated passage when installed in a vehicle rear part.

Referring now to the figures of the drawing in detail and first, particularly, to FIG. 1 thereof, there is shown an end region of an exhaust system 1 of a motor vehicle, which exhaust system 1 has an exhaust pipe 2 and two exhaust pipes 3, 4 branching off therefrom for connecting to inner exhaust pipes 5, 6 which adjoin them upstream. The latter are held in an exhaust tailpipe cover 7 which is pulled on over them and protrudes, for example, through a cutout A of a vehicle rear part 8*a* which is illustrated in more detail in FIG. 7. The exhaust gas flow flows through the exhaust pipe 2 in the arrow direction P, branches into the two adjoining exhaust pipes 3, 4 and then flows into the inner exhaust pipes 5, 6 and then discharges to the outside.

The exhaust pipe 2 and the adjoining exhaust pipes 3, 4 are connected to the exhaust tailpipe cover 7 via a holding device 10 (FIG. 3) which is fastened to the exhaust pipes 3, 4. The holding device 10 contains a protruding holding tongue 11 which is disposed in a vertical center plane of the exhaust pipes 3, 4 and can be introduced into a T-groove-shaped receptacle 12 or a similar receptacle of the exhaust tailpipe cover 7, and the holding tongue 11 is supported in a precise position and is secured via a fastening screw 14.

For this purpose, the holding tongue 11 has a fixed threaded nut 13 into which the fastening screw 14 is screwed, for which purpose the latter is inserted into a bore 15 of the exhaust tailpipe cover 7.

Figure 5:
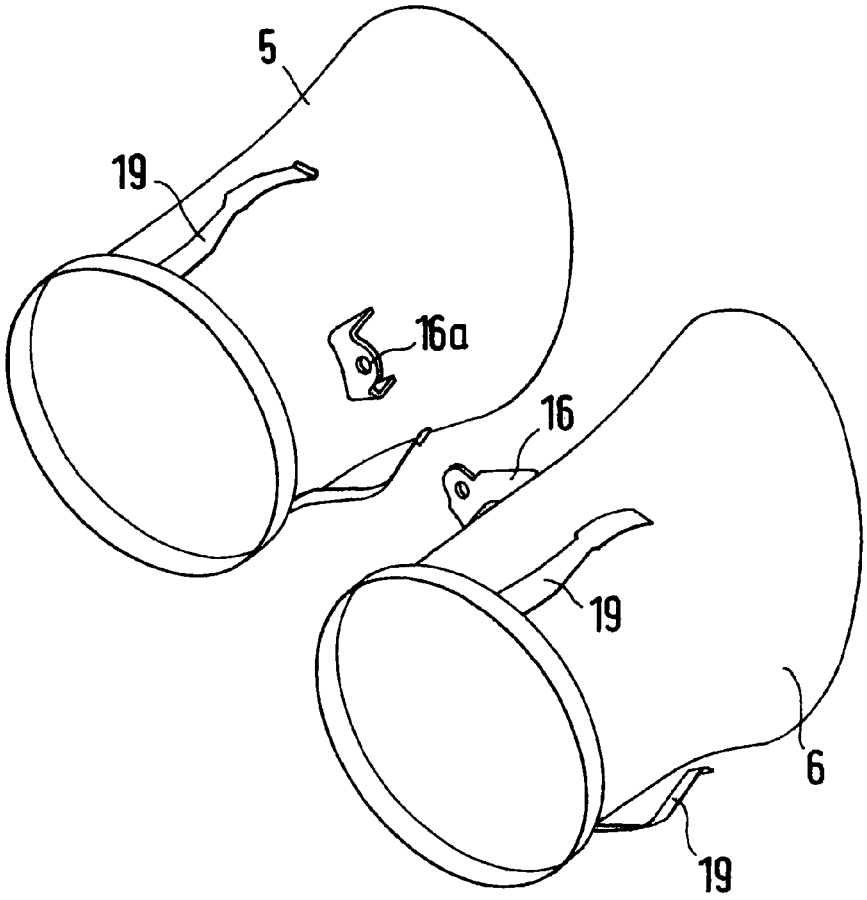
FIG. 5 is a diagrammatic, perspective view of the inner exhaust pipes with resilient clamping elements and supporting limbs.
Figure 6:
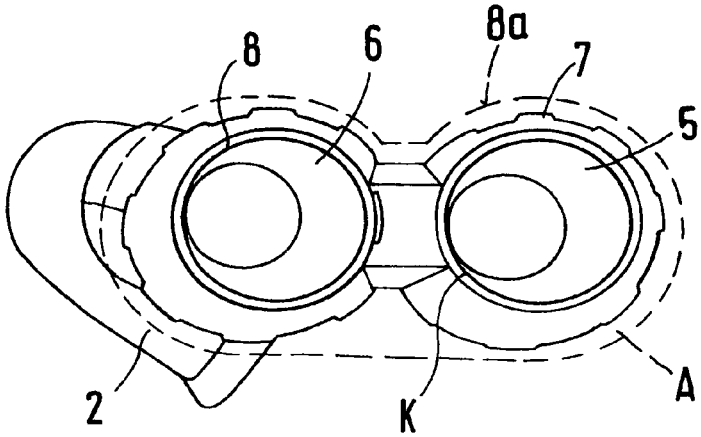
FIG. 6 is a diagrammatic, perspective view of the fitted end region of the exhaust system with a visible gap and air throughflow passage between the inner exhaust pipes and the exhaust tailpipe cover.

Furthermore, the inner exhaust pipes 5, 6 are connected to the exhaust tailpipe cover 7, for which purpose the inner exhaust pipes 5, 6 have, on their outer circumferential surface, two opposite supporting brackets 16, 16*a* which, when pushed into the exhaust tailpipe cover 7, are supported on steps disposed on a side of the receptacle 12 which can be secured in the steps via screws 17, 18. For a spaced-apart mounting in the exhaust tailpipe cover 7, a plurality of resilient clamping elements 19 are disposed distributed over an outer circumference of the inner exhaust pipes 5, 6 (see FIG. 5).

So that the exhaust gas flow P can flow via the exhaust pipe 2 and the adjoining exhaust pipes 3, 4 into the inner exhaust pipes 5, 6, the latter have a tight connection to the exhaust pipes 3, 4. Their tight connection contains in each case a widened pipe portion 20, into which an opposite pipe end 21 of the exhaust pipes 3, 4 can be plugged.

The inner exhaust pipes 5, 6 are disposed in the exhaust tailpipe cover 7 in such a manner that an air passage K running all the way around is formed between the inner exhaust pipes 5, 6 and the exhaust tailpipe cover 7, and therefore, in the driving mode, an air throughflow can take place so that removal of heat is ensured and the exhaust tailpipe cover 7 is no longer exposed to any substantial radiation of heat and the vehicle rear part is kept largely free from harmful effects of heat.

The exhaust tailpipe cover 7 can be composed, for example, of an aluminum casting or of a sheet-metal part, with it being possible for the inner exhaust pipe 5, 6 to be composed of special steel, for example, titanium.

We claim:

1. An exhaust system for a motor vehicle, comprising:

two exhaust pipes;

a holding device;

an exhaust tailpipe cover supported by said exhaust pipes and disposed in a cutout of a vehicle rear part, said exhaust tailpipe cover connected to at least one of said exhaust pipes via said holding device; and two individual inner exhaust pipes disposed in each case between said exhaust tailpipe cover and said exhaust pipes and plugged onto said two exhaust pipes, said individual inner exhaust pipes connected fixedly to said exhaust tailpipe cover and together creating a continuous passage formed all a way around between said two individual inner exhaust pipes and said exhaust tailpipe cover accommodating them.

2. The exhaust system according to claim 1, wherein:

said holding device is fastened between said two exhaust pipes;

said exhaust tailpipe cover has a receptacle; and said holding device has a threaded screw and a protruding holding tongue disposed in a vertical center plane of said two exhaust pipes, said protruding holding tongue being pushed into said receptacle of said exhaust tailpipe cover and is held via said threaded screw.

3. The exhaust system according to claim 2, wherein:

said exhaust tailpipe cover has a bore formed therein; and said holding device has a threaded nut fastened on said protruding holding tongue, and said threaded screw being guided in said bore of said exhaust tailpipe cover to said threaded nut and can be connected to said threaded nut.

4. The exhaust system according to claim 2, wherein said two inner exhaust pipes have screwing fasteners, outer circumferential surfaces and a plurality of outwardly prestressed, resilient clamping elements disposed on said outer circumferential surfaces, said resilient clamping elements, when inserted in said exhaust tailpipe cover, are supported in a manner held on an inner wall of said exhaust tailpipe cover, and a fixed connection to said exhaust tailpipe cover takes place via said screwing fasteners.

5. The exhaust system according to claim 4, wherein:

said exhaust tailpipe cover has stops disposed adjacent said receptacle and said receptacle is a dovetailed receptacle; and said two inner exhaust pipes have mutually facing, protruding supporting limbs fastened to said outer circumferential surfaces and, when introduced into said exhaust tailpipe cover, said protruding supporting limbs are supported on said stops disposed on a side of said receptacle and are secured via said screwing fasteners.

6. The exhaust system according to claim 1, wherein said two inner exhaust pipes each have a widened pipe portion receiving said two exhaust pipes plugged in tightly, said two inner exhaust pipes having free ends facing away from said widened pipe portion and have, all a way around, an air gap with respect to an inner circumferential surface of said exhaust tailpipe cover at least at a discharge region of exhaust gases.

7. The exhaust system according to claim 1, wherein:

said exhaust tailpipe cover ends in mouth regions and has an inner wall; and said inner exhaust pipes widen in a trumpet-shaped manner in a discharge region defining mouth regions, and an air gap is formed between said mouth regions of said exhaust tailpipe cover and said mouth regions of said inner exhaust pipes, and said inner exhaust pipes are each disposed at a distance from said inner wall in said exhaust tailpipe cover, and said continuous passage is produced as an air gap insulation.

8. The exhaust system according to claim 1, wherein said exhaust tailpipe cover is composed of a single-part cast part, and said inner exhaust pipes are composed of special steel and are of a thin-walled configuration.

* * * * *